United States Patent [19]

Bergson

[11] 4,087,661

[45] May 2, 1978

[54] SWITCH ENCLOSURE FOR HAZARDOUS ENVIRONMENT HAVING COVER REMOVAL INTERLOCKING DEFEATER ASSEMBLY

[76] Inventor: Gustav Bergson, Cedarbrook Hill Apts., 11, Apt. B-117, Wyncote, Pa. 19095

[21] Appl. No.: 624,504

[22] Filed: Oct. 21, 1975

[51] Int. Cl.[2] ..... H01H 9/20

[52] U.S. Cl. ..... 200/50 R; 70/DIG. 57; 200/293

[58] Field of Search ..... 200/50 A, 50 R, 50 C, 200/329–340, 293, 42 R, 42 T; 307/112, 326, 328; 292/262, 348, 351, DIG. 65; 70/DIG. 57; 116/148

[56] References Cited

U.S. PATENT DOCUMENTS

| | | | |
|---|---|---|---|
| 1,142,732 | 6/1915 | Schoell | 70/DIG. 57 |
| 1,337,137 | 4/1920 | Kaplan | 70/DIG. 57 |
| 1,472,043 | 10/1923 | Boge | 70/DIG. 57 |
| 1,595,853 | 8/1926 | Canfield | 200/336 X |
| 2,237,797 | 4/1941 | Snow | 200/336 X |
| 2,348,393 | 5/1944 | Krieger | 200/334 |
| 2,542,332 | 2/1951 | Holmsten | 70/DIG. 57 |
| 2,855,795 | 10/1958 | Beal | 200/50 C X |
| 2,951,138 | 8/1960 | Petrino | 200/336 X |
| 3,458,226 | 7/1969 | Carlston | 292/268 |
| 3,900,740 | 8/1975 | Akimoto et al. | 307/112 |
| 3,914,660 | 10/1975 | Stearley | 200/336 X |

*Primary Examiner*—James R. Scott
*Attorney, Agent, or Firm*—Jackson and Chovanes

[57] ABSTRACT

A simple and economical means for assuring the removal of electrical power from the equipment in an enclosure when in a hazardous environment, and from the enclosure itself, before the enclosure is opened to that environment, by including an arm which in the "On" position of the equipment switch, extends immediately over the head of a bolt whose removal is necessary for opening of the enclosure, and in the "Off" position of the equipment switch is no longer over the head of that bolt.

7 Claims, 7 Drawing Figures

SWITCH ENCLOSURE FOR HAZARDOUS ENVIRONMENT HAVING COVER REMOVAL INTERLOCKING DEFEATER ASSEMBLY

BRIEF SUMMARY OF THE INVENTION

In many industrial applications, electrical apparatus is housed in special enclosures because of hazardous conditions and it is sometimes important to have a means of insuring that the electrical power is removed from the equipment before the enclosure is opened. Power removal to a remote point, wherein there will be manual reinsertion at that point, is required under some circumstances. It is a purpose of the present invention to establish a means for realizing these objectives.

It will of course be understood by one skilled in the art that the fundamental purpose of the above is a matter of tending to insure safety and reduce risk, in a situation where otherwise there may be at least some chance of something undesirable like an explosion resulting if the explosion-proof setup has its enclosure opened up in the face of a hazardous environment while the electric power is still on in or unduly near the electrical equipment.

BRIEF DESCRIPTION OF THE DRAWINGS

Understanding the invention will be aided by referring to the drawings, wherein.

DETAILED DESCRIPTION

Figure 1:
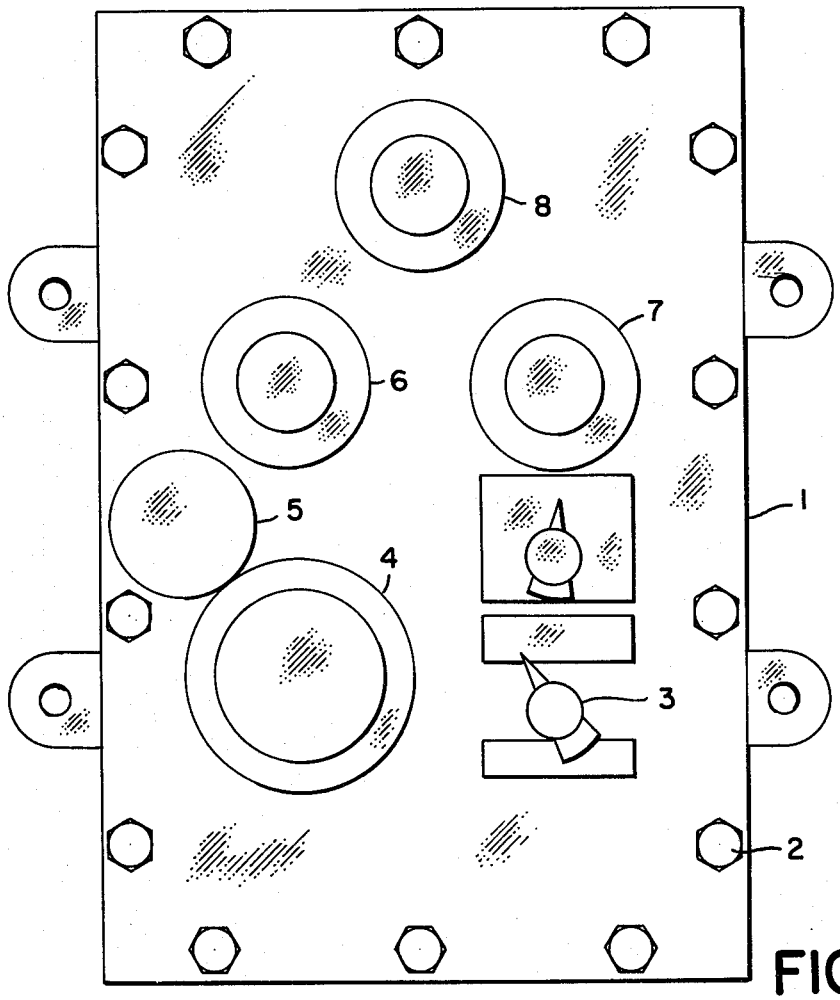
FIG. 1 is a plan view of a particular preferred embodiment of my invention, leaving out the arm attached to th knob, for greater clarity of illustration.

FIG. 1 is a plan view of an explosion proof analyzer whose 1 inch thick aluminum panel is bolted on to the main housing with 14 hexagonal headed (known as hex headed), ¼–20 bolts, the housing mounting lugs are at the rear.

Figure 2:
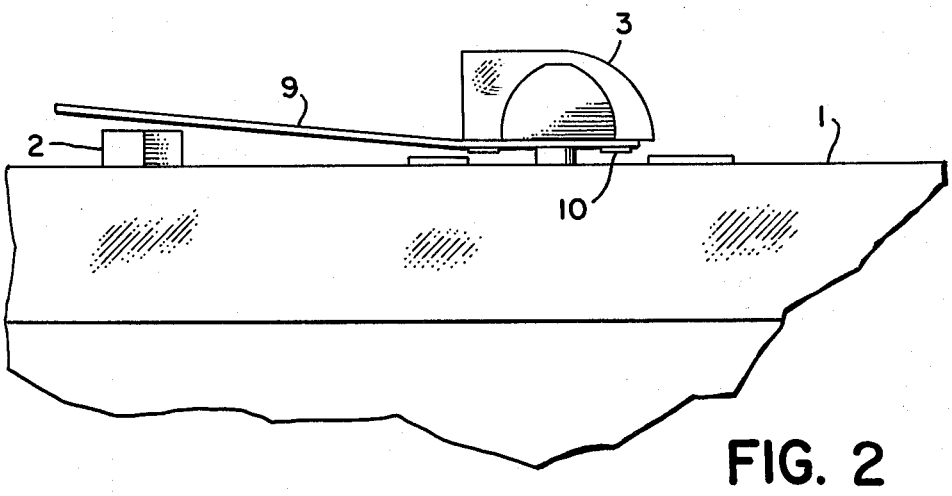
FIG. 2 is an enlarged fragmentary side view of a portion of that same embodiment, including especially the knob, the shaft, the arm, and the bolt which is incapable of being removed in one particular position of the knob.

FIG. 2 shows an end view of a section of the 1 inch thick aluminum panel and the main body of the enclosure wherein it is noted that the bolt whose hex head is shown passes through the panel to that main body case, which is a casting, below, panel and case having finishes at their areas of juncture which are measured in microinches for close contact. The figure shows the bolt removal blockage arm which is affixed to the switch knob and which is important with respect to this invention.

Figure 3:
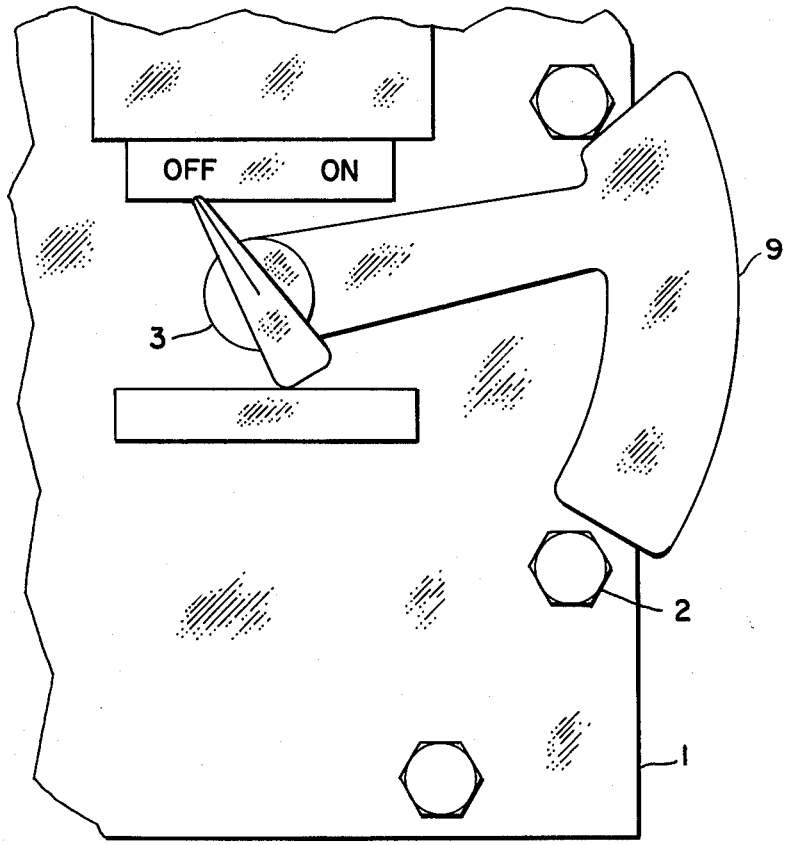
FIG. 3 is an enlarged fragmentary plan view of a portion of the same embodiment, including especially the same things as in FIG. 2.

FIG. 3 shows a plan view of the bolt removal blockage arm affixed to the switch knob wherein the switch is in the "Off" position.

Figure 4:
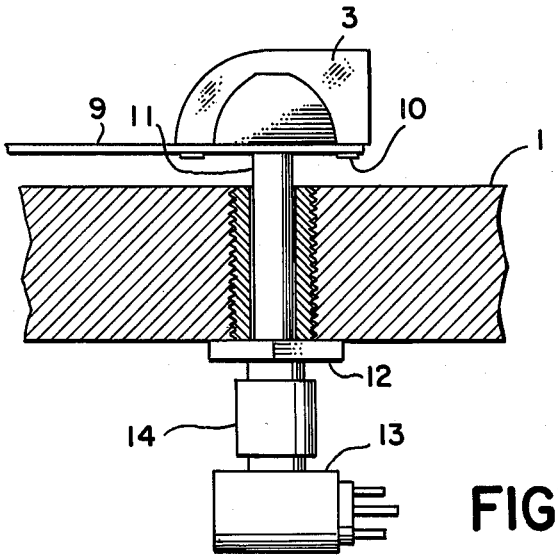
FIG. 4 is an enlarged fragmentary view partly in vertical section through the wall of the enclosure along a line running more or less through the position of the knob, showing the same embodiment and including especially the same things as in FIG. 2 together with an outside view of the switch and the electrical wires leading into it.

FIG. 4 shows a section of the 1 inch panel with the shaft from the knob holding the bolt removal blockage arm by means of two flat head screws wherein the shaft passes through the threaded bushing to the switch. In equipment of the type under consideration it is routine that such passage be made with close tolerances between shaft and bushing.

Figure 5:
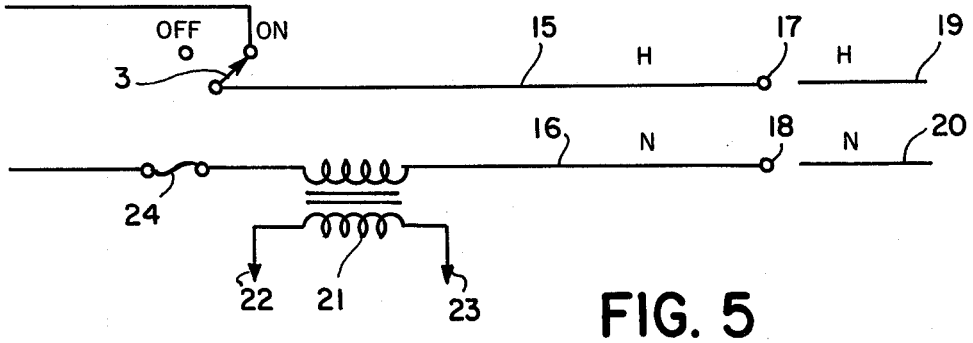
FIG. 5 is an electrical diagram showing one particular illustrative embodiment of the electrical setup forming a particular part of the overall subject matter of my invention, showing a transformer as symbolic of the electrical equipment which is included.

FIG. 5 shows a schematic view of the circuitry wherein the electrical power to the internal equipment is removed when the bolt removal blockage arm no longer blocks the bolt removal as the switch is opened.

Figure 6:
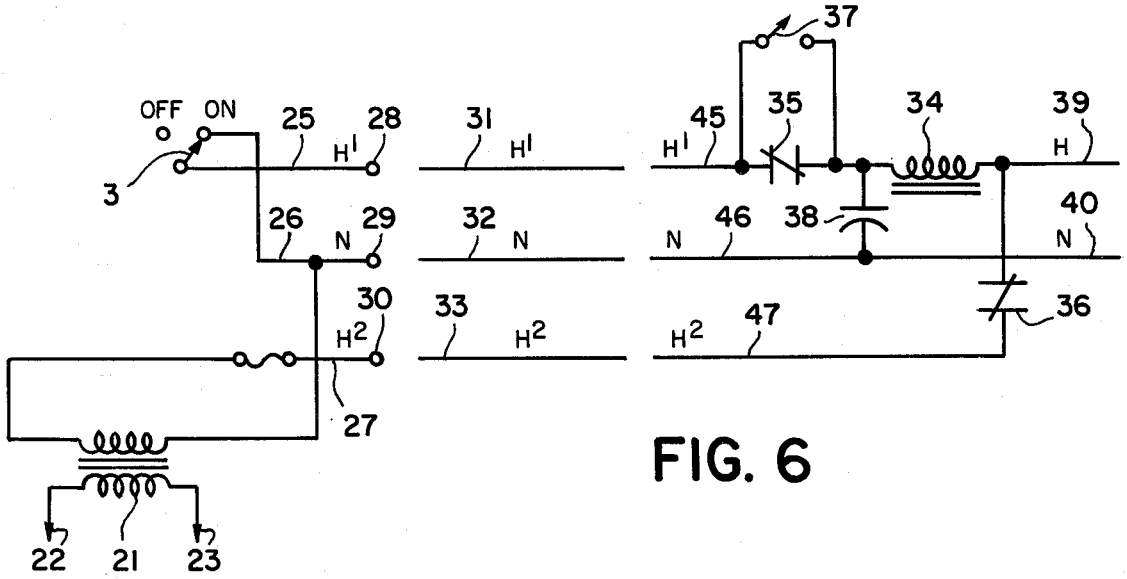
FIGS. 6 and 7 are like FIG. 5, but of different respective embodiments.

FIG. 6 shows a schematic view of the circuitry wherein all electrical power to the enclosure is removed up to a remote point when the bolt removal blockage arm no longer blocks the bolt removal as the switch is opened and wherein manual reinsertion at the remote point is required.

Figure 7:
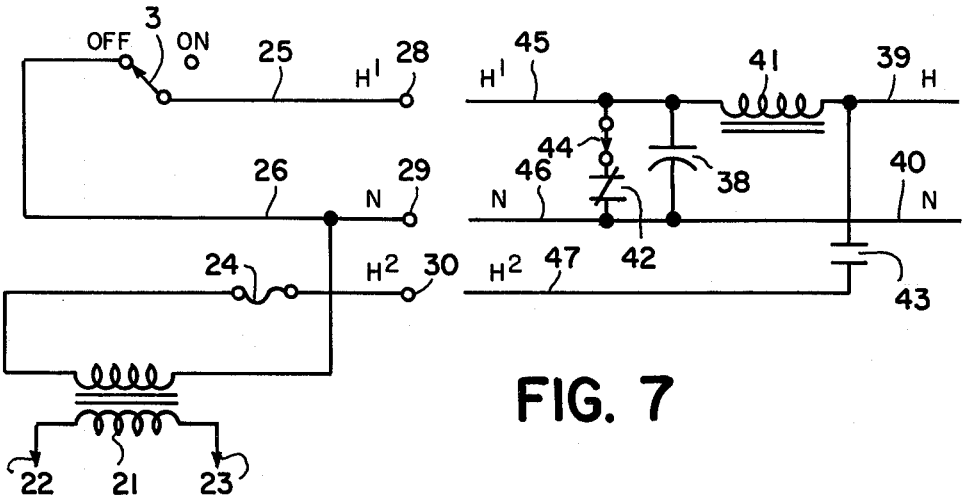

FIG. 7 shows a schematic view of the circuitry wherein all electrical power to the enclosure is removed up to a remote point when the bolt removal blockage arm no longer blocks the bolt removal as the switch is closed and wherein manual reinsertion at the remote point is required.

The transformer 21 with output terminals 22 and 23 is symbolic of the electrical equipment in the enclosure whose electrical power is affected by the operations described herein but which is otherwise optional for our present purposes.

Returning to FIG. 1, the ¼ inch thick tempered glass windows 4, 6, 7 and 8, mounted on the 1 inch thick panel with threaded rings, and a temperature gage 5 whose sensing element projects through the 1 inch panel to measure the internal temperature of the enclosure, are all typical of the type of enclosure under consideration. There is also knob 3 of the power on-off switch which is in the inside of the enclosure and hexagonal head 2 of a bolt whose removal is required in order to obtain access to the inside of the enclosure. This removal will or will not be blocked depending on the position of the bolt removal blockage arm 9, that is, depending on whether the power on-off switch is in the on or off position. The bolt removal blockage arm 9 is shown from the side in FIG. 2 and from the top in FIG. 3 where the circumferential extension requirement is apparent when it is noted that the power on-off switch controlled by knob 3 must be positively off before access to the hex-head of the bolt can be gotten with a tool to permit its removal. The other bolts have no blockage so that they can be freely removed. The recommended practice is to establish freedom for removing bolt 2 first so that some cooling of the internal electrical equipment takes place while the other bolts are being removed. In usage it is sometimes the practice to have a purge gas passing through the enclosure and to insure that any surroundings are cleared from the enclosure before power is reinserted after closing. It is then desirable that in closing, bolt 2 should be the last bolt to be inserted and it is noted that following these procedures gives an added advantage beyond economy and simplicity in the usage of this invention.

In FIG. 2, the affixing of the bolt removal blockage arm to the knob 3 can be seen at the flat head screws 10. In FIG. 4 there is shown a sectional view of the panel 1 with the knob 3, blockage arm 9 and its affixing screws 10. The shaft to the switch passes through the threaded bushing 12 while the switch 13 is held in place by the bushing 14. The particular details of the assembly may vary from one application to another but it is pertinent to the invention that there be a shaft whose rotational position controls a switch, in ways well known to the arts, and including an arm making connection to the shaft so that rotation of the latter will either block or unblock the hex bolt 2, as required.

The circuit description which follows for FIGS. 5, 6, and 7 is not intended to describe anything that is necessarilly novel. For FIG. 5 there is need to add to what has been said, that there is a fuse 24 and the internal hot and neutral lines, 15 and 16 respectively, coming from the internal equipment terminals 17 and 18. Lines from the outside wires 19 and 20 come to these terminals after passing through isolating glands, as required, which are commonly used in such applications and are not shown here. The bolt removal blockage arm has freed the hex bolt for panel removal when switch 3 is in the "Off" position, that is, when the power is removed from transformer 21.

In FIG. 6 there are three internal power lines 25, 26, and 27 coming from the internal terminals 28, 29, and 30, to which the external lines 31, 32, and 33 make connections. In this arrangement, remote external relay 34 is in the energized position when the switch 3 is on, corresponding to blocking the removal of the hex head bolt 2 by bolt removal blockage arm 9. Lines 45, 46, and 47 are continuations of lines 31, 32, and 33. Relay contacts 35 and 36 are closed, the latter making connection at terminal 30 for one side of the power line to the internal equipment, the other side of the power line connection being made via terminal 29 which is common with one side of the relay control line. When the knob 3 is moved to the "Off" position, unblocking the bolt removal blockage arm from hex bolt 2, relay 34 is deenergized opening its contacts 35 and 36. Power is removed from terminals 28, 29 and 30. If on power to the enclosure is to be restored, switch 3 must first be moved to the on position. There is also a spring return normally open switch 37 and this must then be momentarilly closed manually to permit relay 34 to be energized, closing contacts 35 and 36. The capacitor 38 permits discharge of the energy of relay 34 when switch 3 is opened. There are also the hot and neutral power lines 39 and 40 respectively coming into the system.

In FIG. 7 the relay 41 is deenergized when the switch 3 is in the "On" position. When switch 3 is moved to the "Off" position, unblocking hex bolt 2, relay 41 is energized closing its contacts 42 to hold itself in and opening its contacts 43 so that all power to the enclosure terminals 28, 29, and 30 is removed. To restore power to the enclosure, switch 3 is moved to the "On" position. There is also a spring return normally closed switch 44 which must be momentarilly opened manually to open the relay circuit, thereby opening its contacts 42 and closing its contacts 43. Capacitor 38 serves the same purpose as before.

What is claimed is:

1. A combination involving electrical apparatus in explosion proof enclosure in hazardous environment in industry comprising:

(a) electrical equipment, (b) an explosion proof enclosure enclosing that particular electrical equipment and having an explosion proof main casing having an opening for access to the interior and an explosion proof cover member having a closed position in which it closes off the opening and an open position in which access to the interior is permitted, opening of which member is controlled by fastening means, (c) a hazardous environment located outside of the enclosure relative to the electrical equipment, (d) a switch having an On position in which the electrical equipment can be in energized status and an OFF position in which the electrical equipment can not be in energized status, and (e) means to prevent the fastening means from being put in a condition where the cover member is open when the switch is in the On position and to permit the fastening means to be put in a condition where the cover member is open when the switch is in the OFF position.

2. A combination involving electrical apparatus in explosion proof enclosure in hazardous environment in industry involving:

(a) an electrical equipment, (b) an explosion proof enclosure enclosing that particular electrical equipment and having an explosion proof main casing having an opening for access to the interior and an explosion proof cover member having a closed position in which it closes off the opening and an open position in which access to the interior is permitted, opening of which member is controlled by fastening means, (c) a hazardous environment located outside of the enclosure relative to the electrical equipment, (d) a switch having an On position in which the electrical equipment can be in energized status and an Off position in which it can not be in energized status, (e) a control for the switch having an On and Off position respectively determining the switch's On and Off position, and (f) physical structural means moving with the control and blocking the fastening means from assuming a condition in which the cover member is open when the control is in the On position and permitting the fastening means to assume such a condition when the cover member is in the Off position.

3. A combination involving electrical apparatus in explosion proof enclosure in hazardous environment in industry involving:

(a) electrical equipment, (b) an enclosure enclosing that particular electrical equipment and having an explosion proof main casing having an opening for access to the interior and an explosion proof cover member having a closed position in which it is bolted across the opening by a plurality of bolts to close off that opening in an explosion proof manner but will remain in closed position after removal of all but a particular one of the bolts, and an open position in which access to the interior is permitted, opening of which cover member can be prevented by keeping that particular bolt in closed position, (c) a hazardous environment located outside of the enclosure relative to the electrical equipment, (d) a switch having an On position in which the electrical equipment can be in energized status and an Off position in which it can not be in energized status, (e) a knob controlling the switch by being placed in respectively corresponding On and Off positions of the knob, and (f) an arm moving with the knob and having a respectively corresponding On position in which it is positioned above the head of the particular bolt close enough to maintain it in closed position and a respectively corresponding Off position in which the arm is not in any such position and the bolt can be removed.

4. A combination of claim 1, which includes also a relay controlled by the switch, which relay is remote from the switch and external to the enclosure, a switch additional to the previously mentioned switch, which additional switch is operable independently of the previously mentioned switch and can only be operated manually, and means including the relay by which on the opening of the previously mentioned switch, power is completely removed from the enclosure as long as the additional switch is not operated, but can be restored to that enclosure if the additional switch is operated.

5. A combination of claim 3, which includes also a relay controlled by the switch which relay is remote from the switch and external to the enclosure, a switch additional to the previously mentioned switch, which additional switch is operable independently of the previously mentioned switch and can only be operated manually, and means including the relay by which on the opening of the previously mentioned switch, power is completely removed from the enclosure as long as the additional switch is not operated, but can be restored to that enclosure if the additional switch is operated.

6. A setup of claim 3, in which the knob is on and controls the movement of a shaft which is connected to the switch.

7. A setup of claim 3, in which the arm is in the form of a radial member relative to the center of movement of the knob and an arcuate member along part of the circumference toward the end of the radius involved in that radial member.

* * * * *